US005720156A

United States Patent [19]

Bridges et al.

[11] Patent Number: 5,720,156

[45] **Date of Patent: *Feb. 24, 1998**

[54] CASE PACKING APPARATUS AND METHOD

[75] Inventors: Jimmy R. Bridges, Charlotte, N.C.; Phillip S. LaChapelle, Tega Cay, S.C.; Claude E. Monsees, Charlotte, N.C.

[73] Assignee: Roberts Systems, Inc., Charlotte, N.C.

[ * ] Notice: The portion of the term of this patent subsequent to Aug. 26, 2016, has been disclaimed.

[21] Appl. No.: 519,241

[22] Filed: Aug. 25, 1995

[51] Int. Cl.[6] ..... B65B 35/30; B65B 43/26

[52] U.S. Cl. ..... 53/438; 53/448; 53/458; 53/529; 53/542; 53/168; 53/564; 53/242; 53/260

[58] Field of Search ..... 53/447, 443, 397, 53/438, 448, 456, 458, 529, 542, 168, 564, 580, 247, 260, 390, 242, 243

[56] References Cited

U.S. PATENT DOCUMENTS

| | | | |
|---|---|---|---|
| 1,243,406 | 10/1917 | Hawthorne . | |
| 1,824,432 | 9/1931 | Hendry . | |
| 1,953,524 | 4/1934 | Woodward . | |
| 2,220,362 | 11/1940 | Anderson . | |
| 2,727,664 | 12/1955 | Ardell . | |
| 2,734,323 | 2/1956 | Laub, III . | |
| 2,804,738 | 9/1957 | Shenigo . | |
| 2,805,757 | 9/1957 | Rapley . | |
| 2,906,075 | 9/1959 | Vogel . | |
| 3,390,510 | 7/1968 | Crisci . | |
| 3,456,423 | 7/1969 | Helms . | |
| 3,537,361 | 11/1970 | Derderian . | |
| 3,546,829 | 12/1970 | Lonergan . | |
| 3,562,775 | 2/1971 | Mullins . | |
| 3,608,440 | 9/1971 | Reichert . | |
| 3,751,872 | 8/1973 | Helms . | |
| 3,753,333 | 8/1973 | Derderian et al. . | |
| 3,757,486 | 9/1973 | Feurston et al. . | |
| 3,762,129 | 10/1973 | Salomon . | |
| 3,766,706 | 10/1973 | Graham . | |
| 3,783,587 | 1/1974 | Kurtenbach . | |
| 3,805,484 | 4/1974 | Rossi . | |
| 3,808,770 | 5/1974 | Berney . | |
| 3,842,571 | 10/1974 | Focke et al. . | |
| 3,940,907 | 3/1976 | Ganz . | |
| 3,982,474 | 9/1976 | Klund | 53/564 X |
| 4,018,031 | 4/1977 | Smaw . | |
| 4,211,056 | 7/1980 | Birk . | |
| 4,316,354 | 2/1982 | Loewenthal . | |
| 4,506,493 | 3/1985 | Horton . | |
| 4,570,421 | 2/1986 | Focke et al. . | |
| 4,599,845 | 7/1986 | Luoni . | |
| 4,742,670 | 5/1988 | Windsor et al. . | |
| 4,870,803 | 10/1989 | Blumle | 53/448 X |
| 4,873,813 | 10/1989 | Labombarde et al. . | |
| 4,936,816 | 6/1990 | Blumle et al. . | |
| 4,972,651 | 11/1990 | Hamson . | |
| 5,095,684 | 3/1992 | Walker et al. | 53/443 |

FOREIGN PATENT DOCUMENTS

| | | | |
|---|---|---|---|
| 584885 | 3/1994 | European Pat. Off. | 53/458 |
| 2120629 | 12/1983 | United Kingdom | 53/542 |

*Primary Examiner*—Linda Johnson
*Attorney, Agent, or Firm*—Hardaway Law Firm PA

[57] ABSTRACT

An integrated and automated case packing device and method is disclosed. The device and method uses multiple stations to: separate a flattened case from a supply of such cases, detect whether the case in an A or B-type case, open the case according to the type of case, place a predetermined number of imbricated articles into a group standing on edge, move that group under the erected case, place the case over the stationary group, close the flaps to the case, and move the case downstream to a case invertor.

22 Claims, 21 Drawing Sheets

CASE PACKING APPARATUS AND METHOD

RELATED APPLICATIONS

This application is related to co-pending U.S. applications Ser. Nos. 08/519,240, filed Aug. 25, 1995 and 08/519,655, filed Aug. 25, 1995.

BACKGROUND OF THE INVENTION

This invention is directed to improvements in a case packing apparatus and method. A case packing device is one in which a group of articles to be cased is formed, moved to a packing station, placed under an erected case and then cased.

An example of such a device can be found in U.S. Pat. No. 4,972,651 to Hamson. Hamson uses a four sided cage to form his group of vertically tiered articles. This cage makes forming groups of various sizes difficult because it is not easy to adjust the size of the cage. Furthermore, the Hamson device does not provide for such other advantageous features as: completely squaring the group of articles along all surfaces, forming a group of on edge articles, or supporting the cases in its folded case supply in an ergonomically correct configuration.

Accordingly, there is room for improvement within the art.

OBJECTS OF THE INVENTION

It is an object of the invention to provide for a case packing device and method that can case varying sized groups of articles.

It is a further object of the invention to provide for a case packing device and method that can be substantially automated.

It is yet a further object of the invention to provide for a case packing device and method that requires minimal work on behalf of the human operator to reduce the incidence of carpal tunnel syndrome.

It is still yet a further object of the invention to provide for a case packing device and method that can operate a high speeds.

These and other objects of the invention are achieved by a case packing apparatus comprising: a supply of folded cases; a separator for separating one case from the source of cases; a case blank shuttle for feeding the separated case blank downstream; a case unfolding mechanism downstream of the case blank shuttle and to which the case blank shuttle feeds the separated case; a source of incoming imbricated articles; a transfer assembly for: (a) grouping the imbricated articles and standing them on edge and (b) for transferring the group of articles standing on edge to a position under the case unfolding mechanism; and whereby the separated case is unfolded and lowered over the group of articles by the case unfolding mechanism, thereby placing the articles in the unfolded case.

BRIEF DESCRIPTION OF THE DRAWINGS

FIGS. 1, 1B, 2, and 3 are perspective views of a case packer according to the invention.

DETAILED DESCRIPTION OF THE DRAWINGS

Figure 14:
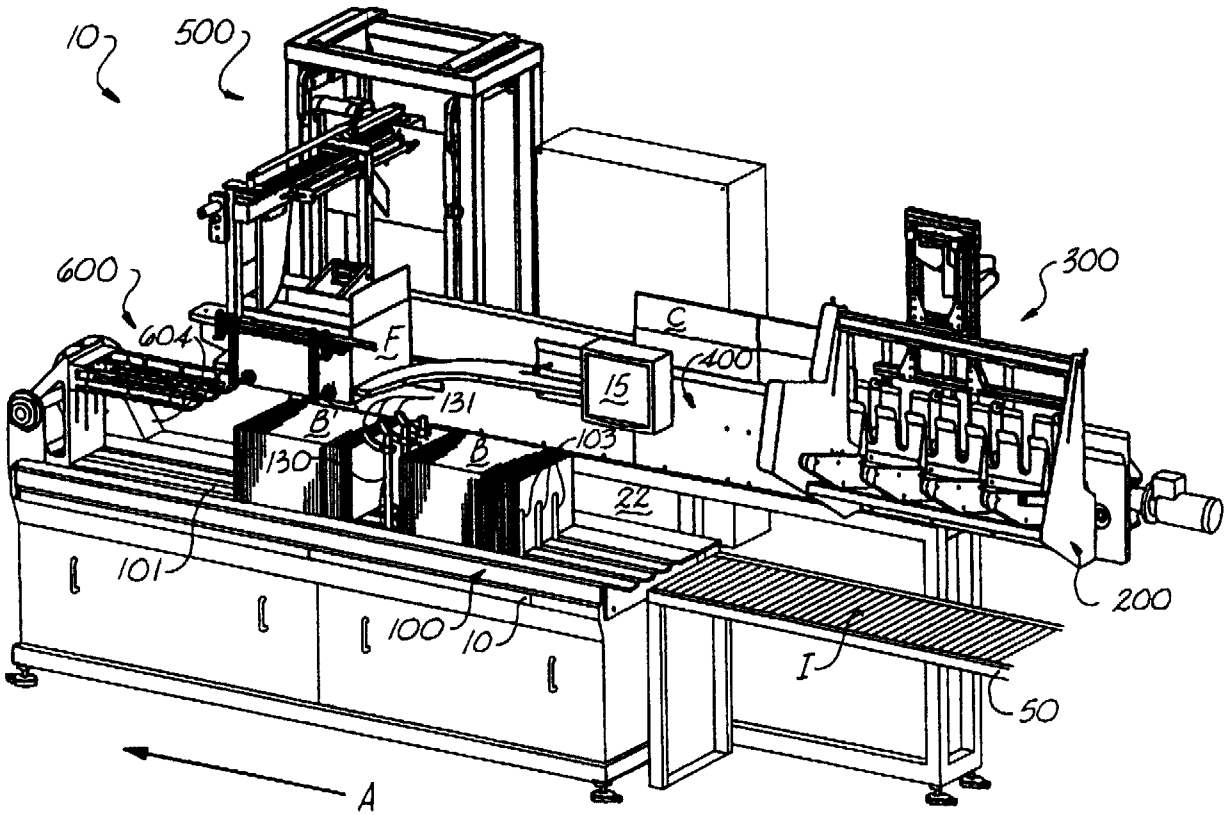
Figure 1B:
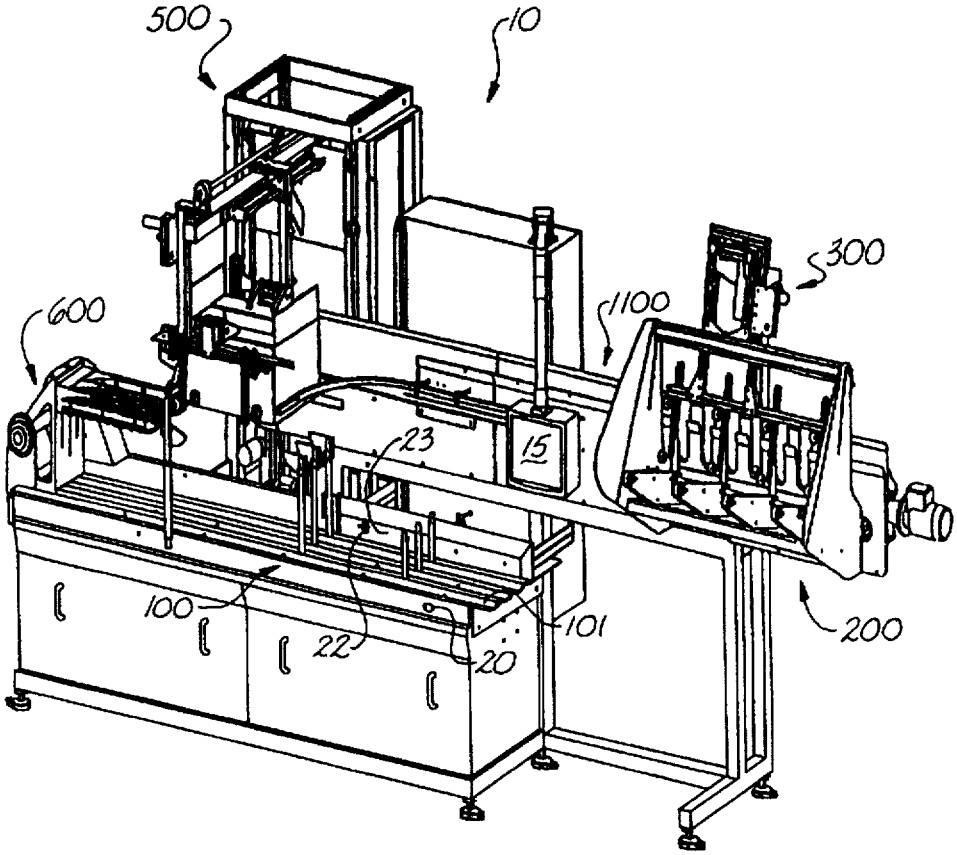
Figure 2:
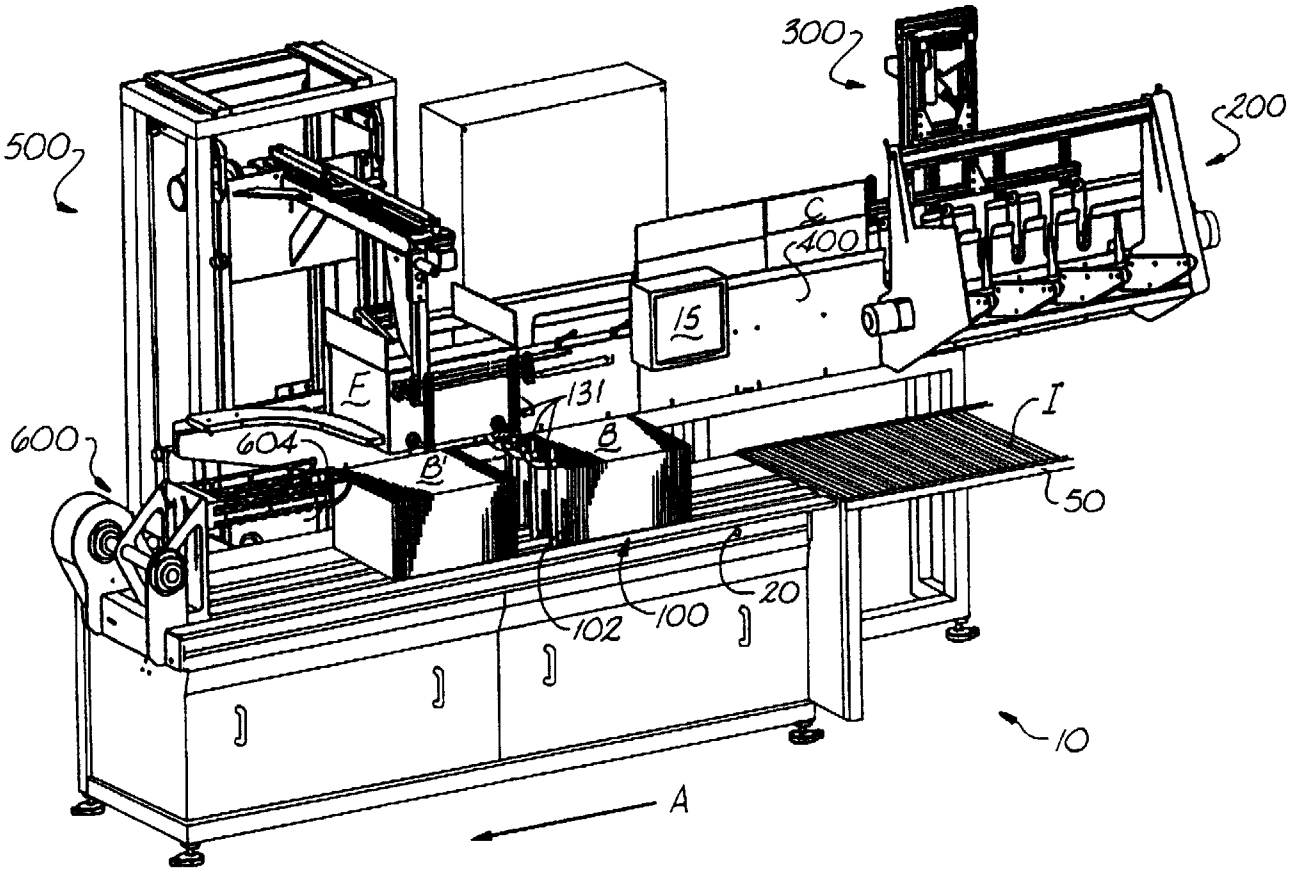
Figure 3:
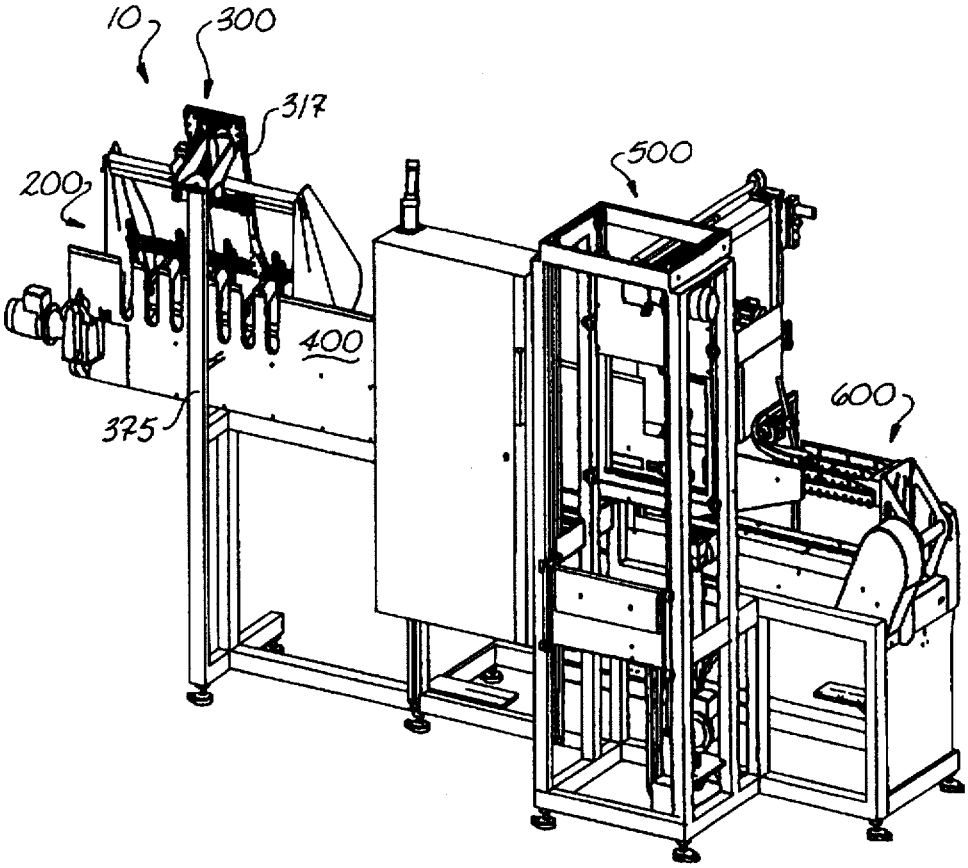

FIGS. 1–3 are perspective views of case packer 10 according to the invention. Case packer 10 is a multi-station device comprising: transfer station 100, case magazine station 200, case blank pick off station 300, case blank shuttle station 400, case unfolding and erecting station 500, and packed case inverting station 600. Monitor 15 informs the operator of the status of case packer 10 and the various stations listed above. Button or switch 20 controls the operation of case packer 10, as will be described below.

Briefly described, case packer 10 operates as follows. Imbricated articles I are fed by conveyor 50 to transfer station 100. Concerning this invention, imbricated articles I are typically folded boxes for packaging goods, such as foodstuffs. However, the invention is not so limited. At transfer station 100, a predetermined number of imbricated articles I are formed into group B, in which each article I is standing on edge, by transfer assembly 100. After group B is formed, transfer assembly 100 moves group B down slatted table surface 101 in the direction of arrow A until it reaches a case packing position directly under case unfolding and erecting station 500, as indicated by group B' shown in FIGS. 1, 2. Meanwhile, a supply of folded and flattened cases are placed into magazine 200. While in the preferred embodiment the cases have flaps at only one end, the invention is not so limited. Case blank pick off station 300 separates a single blank C from magazine 200 and positions it within case blank shuttle station 400. Case C is shuttled downstream to case unfolding and erecting station 500, where case C is unfolded into case F. Then, case F is moved downward with its flapped end up, i.e., trailing, over group B while group B is stationary. Case unfolding and erecting station 500 and plows 131 close the various major and minor flaps of case F. During this time, another group B is formed. As this new group B is moved towards the case packing position, the cased group of articles is then moved into packed case invertor 600, which inverts the cased group of articles and places the entrance to case receiving space 604 adjacent a delivery conveyor (not shown) for delivering the cased group of articles downstream for further processing.

Having described case packer 10 in general, reference will now be made to the other figures to describe the different stations of case packer 10 in more detail. It should be noted that details that would be known to those skilled in the art, such as, but not limited to, a schematic control diagram, views of the various tubes required to feed pressurized air and vacuum to the various fluidic cylinders and vacuum grippers, have been omitted for clarity.

Figure 4A:
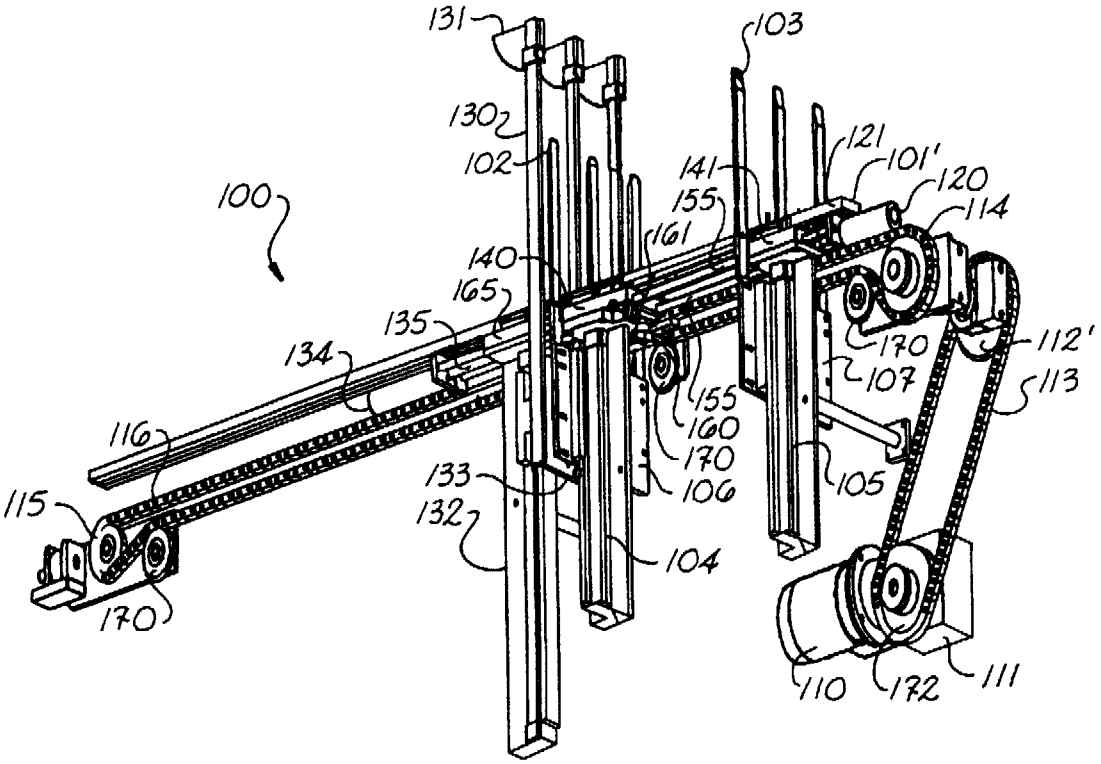
FIGS. 4A is an assembly view of a stack transfer assembly according to the invention.
Figure 4B:
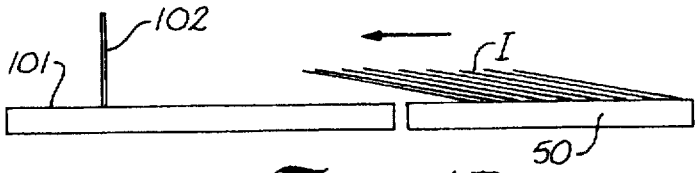
FIG. 4B–F are elevational views showing the various steps required for forming a group of articles to be packed.
Figure 4C:
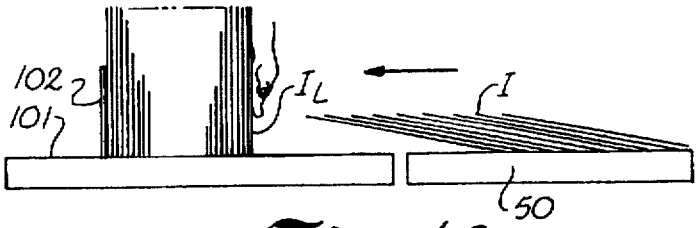
Figure 4D:
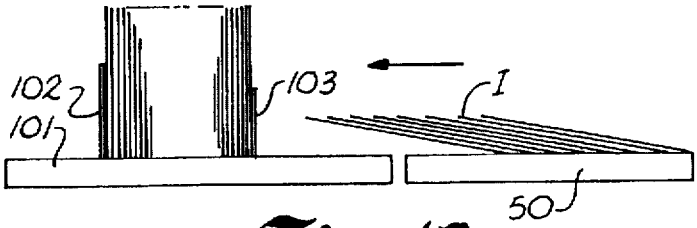
Figure 4E:
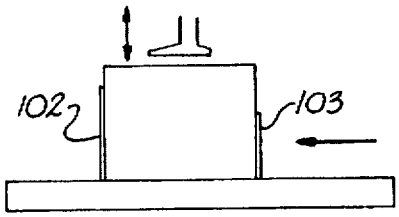
Figure 4F:
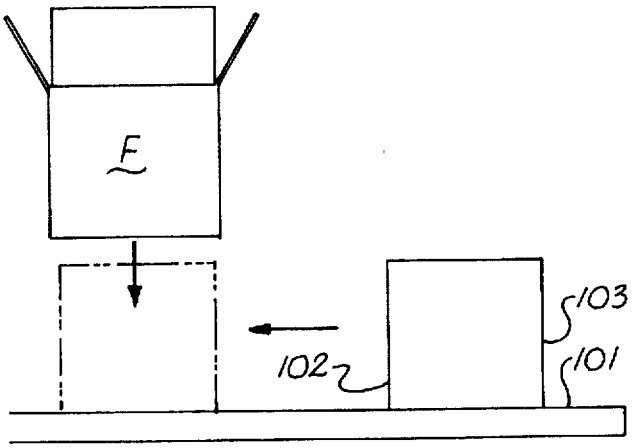
Figure 4G:
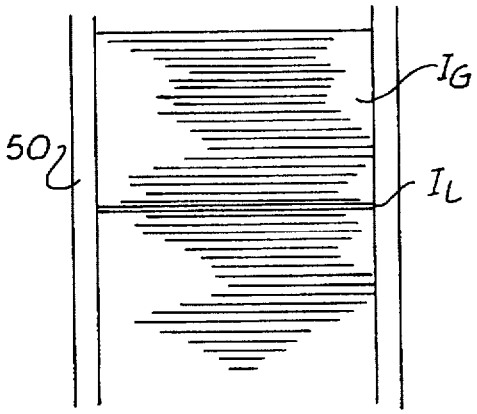
FIG. 4G is a plan view showing a conventional way in which a group of articles is visually indicated to a case packer operator.

FIG. 4B–F show how transfer assembly 100 forms the stream of imbricated articles I into groups B of articles standing on edge. In FIG. 4B, the machine operator has turned on case packer 10, which generates a signal causing fork 102 to automatically protrude up through slatted table surface 101. Meanwhile conveyor 50 feeds imbricated articles I onto slatted table surface 101. As is conventional, a predetermined number of articles is marked off on conveyor 50. This is usually achieved by slightly displacing the last imbricated article $I_L$ of a group $I_G$ with respect to the rest of the flow, e.g., moving it slightly out from being square (FIG. 4G). This gives the operator a visual indication of where a group of articles having a predetermined number of articles begins and ends. In FIG. 4C, the operator grabs the displaced last article $I_L$ and, by lifting it up and moving the articles towards fork 102 with his hand, creates a group B of articles standing on edge. Sensor 23, in back-guide 22, adjacent first fork 102, upon detection of the first couple of articles against fork 102 generates a signal, causing fork 103 to protrude up through slatted table surface 101. This structure is shown in FIG. 1B. The operator may now release the last article because group B is firmly held between forks 102 and 103. In FIG. 4E, the operator, using his or her hands, pats down the tops and sides of group B to neaten and completely square group B against slatted table surface 101 and back-guide 22, respectively. The operator then presses button 20 to generate another signal or case packer 10, itself, generates another signal, causing fork 103 to move towards fork 102, compressing group B. Finally, in FIG. 4F, group B, while held under compression between forks 102 and 103, is moved down slatted table surface 101 until it is positioned at a case packing position (shown in phantom) beneath case unfolding and erecting station 500 so that unfolded case F can be lowered over group B, casing the same.

Having described its operation, the mechanical details of stack transfer assembly or stack transfer station 100, which are shown in FIG. 4A, will now be described. As can be seen from this figure, all working parts for transfer assembly 100 are positioned under slatted table surface 101, except for first, second, and third forks 102, 103, 130, which can be positioned either at a first position below, or at a second position above, slatted table surface 101. The cabinet structure shown in FIGS. 1–3 encase the moving and working parts of transfer assembly 100 that are under slatted table surface 101. To move first and second forks 102, 103 from their first position, below slatted table surface 101, to their second position, above slatted table surface 101, fluidic cylinders 104, 105, respectively, are used. The various fluidic cylinders used with case packer 10 may be pneumatic or hydraulic, although pneumatic cylinders are preferred. Furthermore, it is possible to replace the various fluidic cylinders with other mechanical means, such as motors and linkages. First fork 102 is attached to first cylinder 104 by first carriage 106. Second fork 103 is attached to second cylinder 105 by second carriage 107. Thus, as the various cylinders are independently operated, first and second forks 102, 103 move up and down independently of one another.

First and second forks 102, 103 move back-and-forth across the length of slatted table surface 101, as described with reference to FIGS. 4B–F, by use of a track mechanism arrangement bolted to the underside of the slatted table surface 101 shown in FIGS. 1–3. First and second cylinders 104, 105 are mounted on first and second blocks 140, 141. Blocks 140, 141 slide along track 101' of transfer assembly 100. Track 101' is bolted below slatted table surface 101 (slatted table surface 101 is not shown in FIG. 4A). First block 140 has releasable clamp 160 attached thereto. Clamp 160 locks and unlocks pinion 161 (a second pinion 161 is on the other side of first block 140 and, therefore, out of view.) Racks 155 pass through slots in second block 141 and engage pinions 161 of releasable clamp 160. These slots in second block 141 are biased, e.g., by high friction forces, such that unless a fairly large force is placed on second block 141, there will be no relative movement between second black 141 and racks 155. Thus, when pinions 161 are lock against rotation, this results in first and second blocks 140, 141 and, thus, first and second forks 102, 103 moving together since they are now rigidly interconnected by racks 155. The longitudinal position along racks 155 where they are clamped to first block 140 determines the distance between first and second forks 102, 103, thereby controlling the size of the group of articles that can fit between first and second forks 102, 103. Thus, case packer 10 can easily pack groups of varying sizes.

The structure used for compressing the group of articles will now be described. The body portion of a third fluidic cylinder 120 is rigidly attached to the first ends of racks 155. The retractable shaft 121 of third cylinder 120 is rigidly mounted to second black 141. The forces generated by third cylinder 120 are strong enough to overcome the bias described above between racks 155 and second block 141. Thus, as shaft 121 of third cylinder 120 expands and contracts, second fork 103 is laterally displaced independent from first fork 102, which remains stationary. This provides transfer assembly 100 with the ability to compress the grouped articles so that they can be better cased, as described with reference to FIG. 4E above.

Figure 4H:
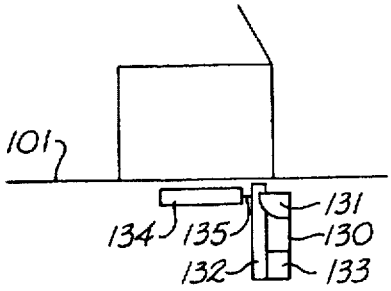
FIGS. 4H–K are elevational views showing how a plow is used to close one of the flaps of the case and move the packed case further downstream.
Figure 4I:
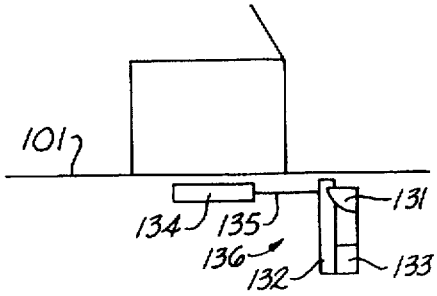
Figure 4J:
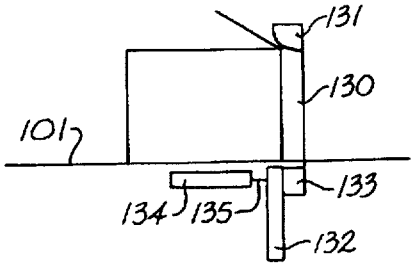
Figure 4K:
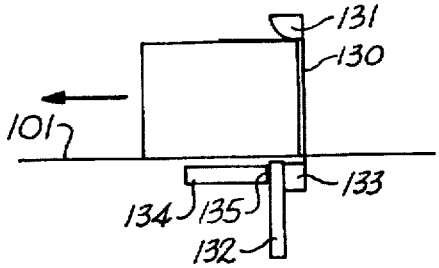

An additional part of transfer assembly 100 is third fork 130. Third fork 130 also has a first position below slatted table surface 101 and a second position above slatted table surface 101. Third fork 130 is connected to third fluidic cylinder 132 by third carriage 133. Third fork 130 moves up-down in the same manner as first and second forks 102, 103 of transfer assembly 100. Third fork 130 is not for holding or manipulating group B of articles. Rather, third fork 130 holds closed one of the minor flaps of the case that is positioned over group B and pushes the cased group of articles B into packed case invertor 600, as described later. This is achieved by use of plows 131. As shown in FIG. 4H, third fork 130 cannot move straight up and down due to the presence of group B, which would interfere with plows 131. Therefore, to properly position third fork 130 in a position where plows 131 can hold close the right minor case flap, third cylinder 134, via shaft 135, pushes fork 130, moving plows 131 out of the path of group B (FIG. 4I). Then, plows 131 are moved above the cased group of articles (FIG. 4J), closing the right minor flap (FIG. 4K).

Third fork 130 is mounted on third block 165, which also slides along track 101'. The body portion of fourth cylinder 134 is rigidly mounted to the other ends of racks 155. Racks 155 pass through biased slots in third block 165, in the same manner as described with respect to second blocks 141. Because both second and third forks 102, 130 are biased against movement with respect to the same racks 155, when clamp 160 is released allowing pinions 161 to rotate, and second fork 102 is moved, e.g., to the left, third fork 130 moves the same amount to the left. This is required because second fork 102 and third fork 130 must always be adjacent the right (rear) end of the stack of grouped articles. For kicking third fork 130 as described above, shaft 135 of fourth cylinder 134 is rigidly mounted to third block 165. Thus, as shaft 135 of fourth cylinder 134 expands and contracts, third fork 130 is laterally displaced independent with respect to racks 155, thereby kicking third fork 130 in and out of a position that is blocked by the cased articles.

For actually moving the three forks of transfer assembly 100 back-and-forth across track 101', a drive mechanism is provided. The drive mechanism includes first motor 110 having transmission 111 mounted thereto. The output shaft of transmission 111 has first drive sprocket 112 mounted thereon. First drive sprocket 112 transfers rotational energy to first idler sprocket 112', positioned under a first end of track 101', via first chain 113. Second drive sprocket 114 is rigidly mounted on the same drive shaft as first idler sprocket 112' and therefore rotates therewith. Second idler sprocket 115 is mounted under the other end of track 101' and is connected to second drive sprocket 114 via second chain 116. First block 140 is attached to second chain 116, which is prevented against sagging by idler sprockets 170. Thus, as motor 110 operates, causing second chain 116 to move via first chain 113 and both chains' associated sprockets, first block 140 also moves. Finally, because second and third blocks 141, 165 are rigidly connected to first block 140 by use of locked pinions 161 and racks 155, second and third blocks 141, 165, and their respective forks 103, 130 also move. In place of sprockets and chains, it is possible to use pulleys and belts.

Figure 5B:
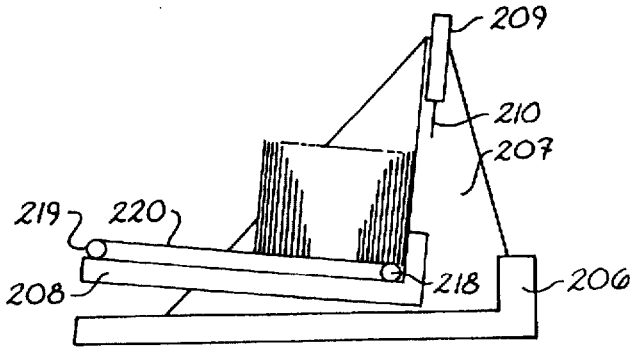
FIG. 5B is an elevational view of the case magazine for use with the case packer according to the invention.
Figure 5A:
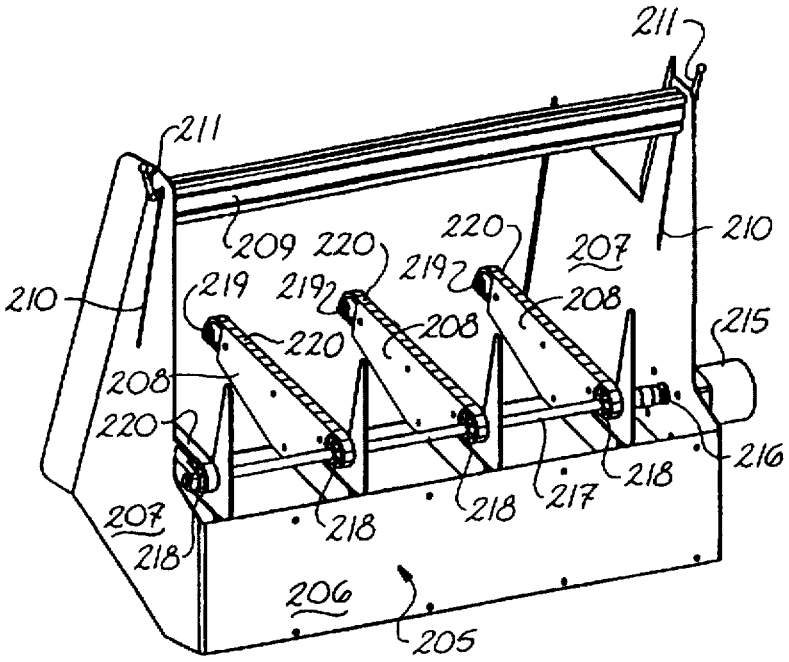
FIG. 5A is an assembly view of a case magazine for use with the case packer according to the invention.

FIG. 5A shows case magazine 200, which holds the folded and flattened cases that will be unfolded and placed over group B of articles. Case magazine 200 has a housing 205 made up of: two side walls 207, front wall 206, and cross-member 209. A plurality of supports 208 are inclined towards front wall 206 and generally L-shaped. Accordingly, the folded and flattened cases lie at an angle, supported by both portions of L-shaped support 208 (FIG. 5B). This angled stacking configuration has been found to be much more ergonomically correct for the operator who constantly replenishes magazine 200. Older methods, such as where the folded and flattened cases either lie on their faces or stand straight up, have been found to be uncomfortable for workers to deal with, place great stress on their wrists, and are thus sources of carpal tunnel syndrome. With the instant invention, the risk of carpal tunnel syndrome is greatly reduced.

To keep the cases firmly against L-shaped support 208, a drive system is used to pull the lower edges of the cases towards L-shaped support 208. This drive mechanism comprises a series of chains 220, wrapped around idler sprockets 219 and drive sprockets 218. All drive sprockets 218 are rigidly mounted to shaft 217, which is driven by motor 215 through coupling 216. Note that it is entirely possible to use belts and pulleys instead of chains and sprockets. Finally, cross-member 209 can move up-down in slots 210 and is locked into place using clamps 211. Cross-member 209 can be used to support accessories, such as double-feed preventing mechanisms.

Figure 6A:
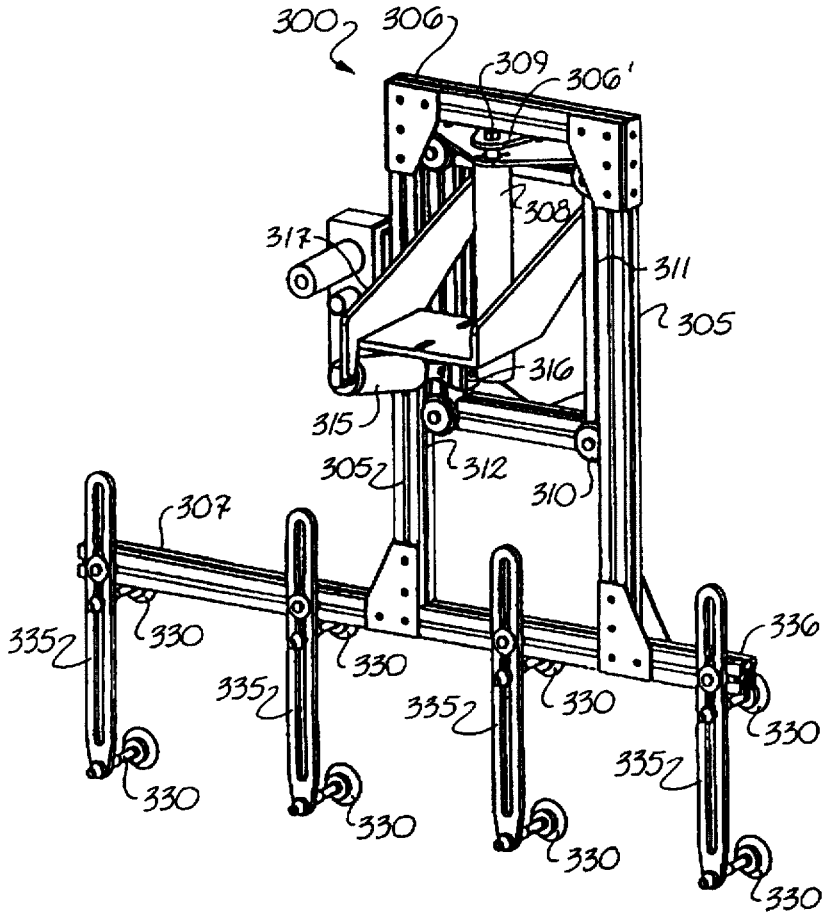
FIGS. 6A and 6B are assembly views of a case blank pick off mechanism for use with the case packer according to the invention.
Figure 6B:
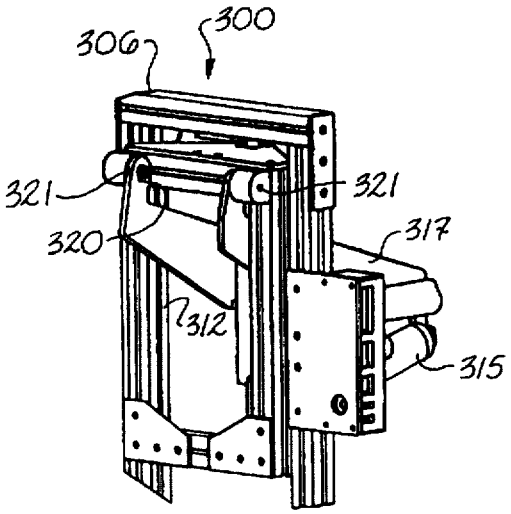

To separate single cases from magazine 200, case blank pick off 300 is used. This assembly is shown in FIGS. 6A and 6B and comprises a much more mechanically simple arrangement than those of the prior art. Blank pick off 300 has two modes of movement, namely up-down and pivoting. To achieve these two modes of movement, a two-part or two-portion frame is used in which the two parts or portions can move with respect to each other in the up-down direction and move together in the pivoting direction. The two-part frame is supported a fixed distance above the ground by use of beam 375 (FIG. 3). Attached to the top of beam 375 is bracket 317. First frame portion 311 is mounted for pivotal movement with respect to bracket 317 by use of rotatable bearings 321 and shaft 320. Rotatable bearings 321 are rigidly mounted to first frame 311. To make first frame 311 pivot back-and-forth, fluid cylinder 315 is attached at one of its ends to a fixed point on bracket 317 and at its other end to a point on first frame 311. Thus, as fluid cylinder 317 expands and contracts, first frame 311 pivots about shaft 320. To provide the up-down movement, a second frame portion is used. The second frame surrounds first frame 311 and supports gripper members 330. The second frame is made up of top rail 306, side rails 305, and cross rail 307. The area bounded by top rail 306 and side rails 305 is slightly larger than that of first frame 311, such that first frame 311 just fits within this bounded area of the second frame. To link the first and second frames together for common movement in the pivoting direction, wheels or rollers 310 are mounted at the corners of the first rail 311 and fit and roll within grooves 312 in the inside walls of side rails 305. To make the second frame move up and down with respect to first frame 311, fluid cylinder 308 is attached at one of its ends to a fixed point on first frame 311 and at its other end to top rail 306 through flange 306'. Thus, as fluid cylinder 308 expands and contracts, the second frame, while still being physically attached to first frame 311, translates with respect to first frame 311 using wheels or rollers 310.

Grippers 330 of case blank pick off 300 are preferably vacuum grippers, although the various conventional vacuum lines are not shown in FIG. 6A for clarity. Grippers 330 are mounted, in pairs, on arms 335. Arms 335 are adjustably mounted to cross rail 307 so that cases of various sizes may be separated. Similarly, and for the same reason, the upper gripper of each pair is also adjustably mounted.

Figure 6C:
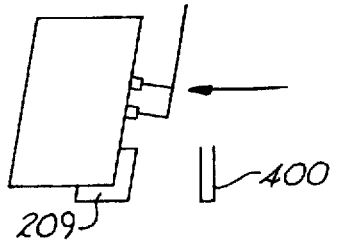
FIGS. 6C–G are elevational views showing the operation of the case blank pick off mechanism for use with the case packer according to the invention.
Figure 6D:
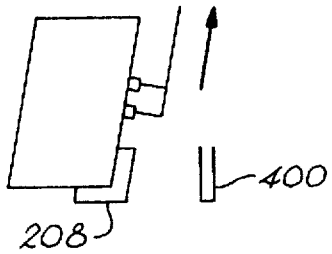
Figure 6G:
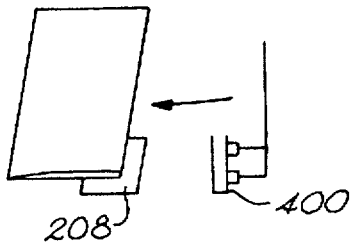
Figure 6E:
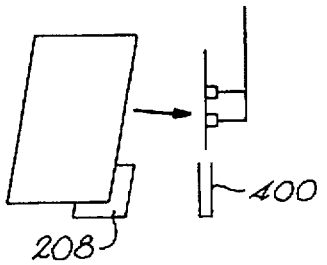
Figure 6F:
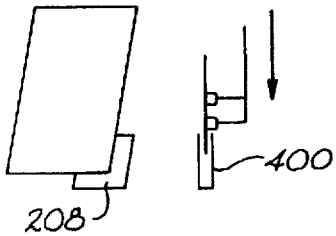

Case blank pick off 300 operates as follows. First, cylinder 315 is signalled to expand and pivot first frame 311, second frame, and grippers 330 towards the first case to be separated in magazine 200 (FIG. 6C). Upon grippers 330 having come into contact with and gripped this case, cylinder 308 is signalled to expand, thereby raising second frame, grippers 330, and the case gripped thereto. This lifts the case a distance slightly greater than the height of the upwardly extending leg of L-shaped support 208, thus freeing the case from the L-shaped support 208 (FIG. 6D). Then, cylinder 315 is signalled to contract and pivot first frame 311, second frame, grippers 330, and the gripped case away from magazine 200 until the gripped case is directly over case shuttle assembly 400, whereat the pivoting is stopped (FIG. 6E). Then, cylinder 308 is signalled to contract, thereby lowering the second frame, grippers 330, and the gripped case until the case is within path 403 of case shuttle assembly 400 (FIG. 6F). Finally, after case shuttle assembly 400 moves this separated case downstream, and after an adequate time delay, the process is restarted by cylinder 315 being signalled to expand again (FIG. 6G).

Figure 7A:
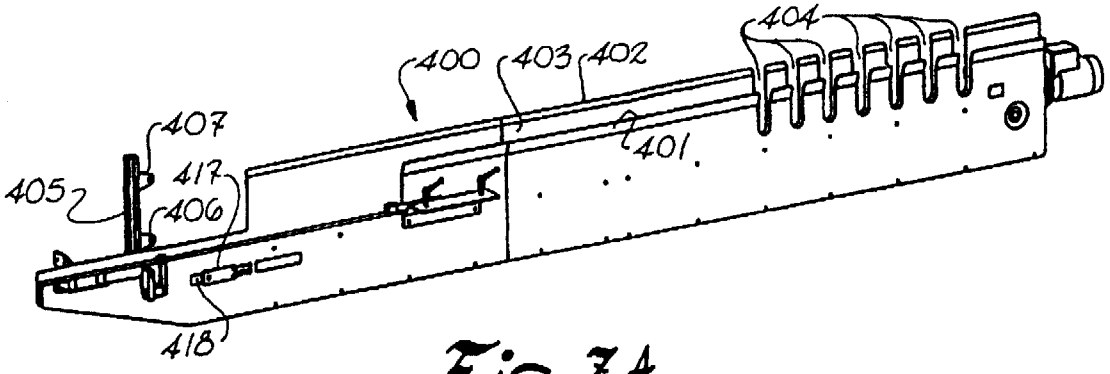
FIGS. 7A–C are assembly views of a case blank shuttle for use with the case packer according to the invention.
Figure 7B:
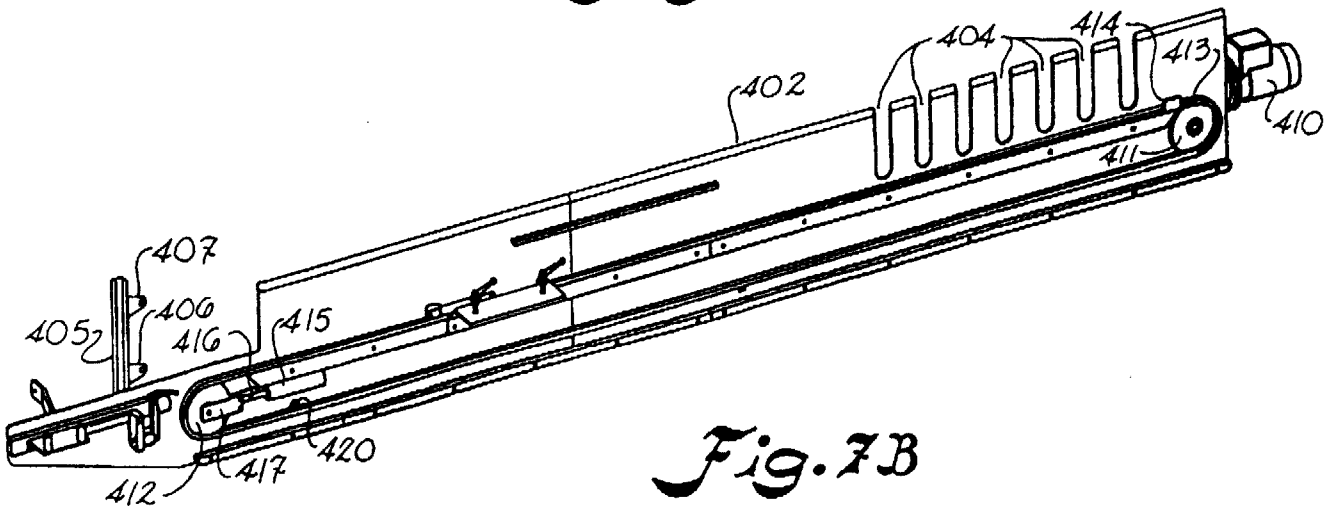
Figure 7C:
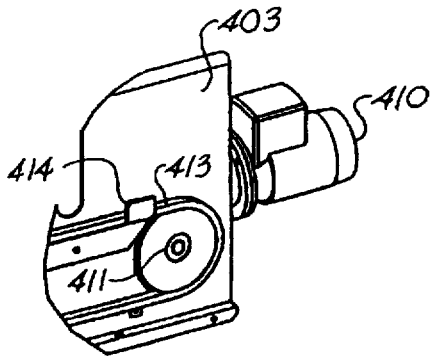

Case shuttle assembly 400, which can also be called article feeding assembly 400, is shown in FIGS. 7A–C. Cases are individually fed through case feed path 403 defined by the space between front and rear face plates 401, 402. Front and rear face plates 401, 402 have slots 404 though which grippers 330 of case blank pick off 300 can pass upon their pivoting back toward magazine 200, as described above and shown in FIG. 6G. For feeding the individual cases downstream, a conveyor is provided. This conveyor comprises: motor 410 for driving the conveyor, driven sprocket 411, idler sprocket 412, chain 413 spanning the two sprockets, and a series of lugs 414 about the outer surface of chain 413. As chain 413 rotates, lugs 414 push on the lower rear edge of a case, thereby pushing the case downstream. To control the tension of chain 413, a chain tensioning mechanism 420 is provided. Mechanism 420 comprises mounting idler sprocket 412 on shuttle plate 417, slidably mounted within slots 418 in front and rear face plates 401, 402. Shuttle plate 417 is connected to fluid cylinder 415 by shaft 416. Accordingly, by expanding or retracting cylinder 415 to expand or retract shaft 416, the tension on chain 413 can be increased or decreased, respectively. As with other parts of the case packer according to the invention, it is possible to replace chain 413 and sprockets 411, 412 with belts and pulleys.

Finally, to detect whether a case being fed is an A or a B type case, the significance of which will be described below, sensors 406, 407 are provided and mounted on sensor arm 405. Whether the case being fed is A or B type, determines how far the case is fed with respect to case unfolding and erecting station 500 as detected by an encoder (not shown). Sensor 405 detects the front edge of the case being fed. Sensor 406 detects the type of case by looking for an indicia on the case that indicates as such. For example, an A case will have a black spot, printed in ink, which when detected by sensor 406 tells the rest of case packer 10 that the case is an A case. When sensor 406 does not detect the spot, sensor 406 indicates that the case is a B case.

Figure 10B:
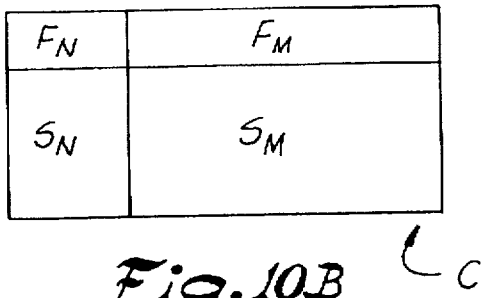
FIGS. 10A–C are elevational views of A and B type boxes, also showing how A and B type boxes are made.
Figure 10A:
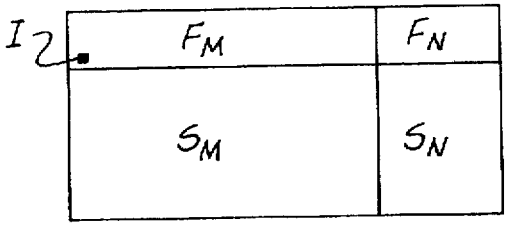
Figure 10C:
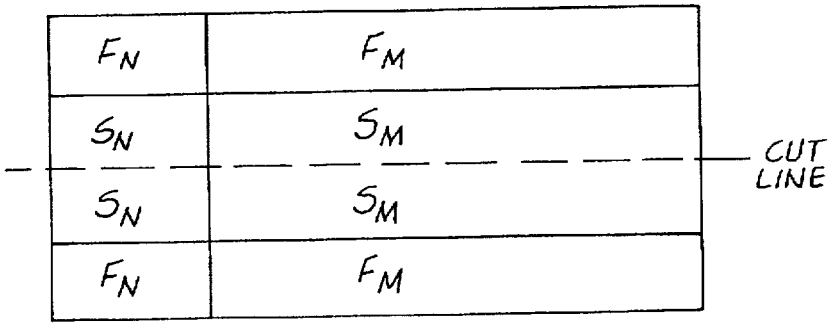

FIGS. 10A and B show the difference between A and B type cases as discussed immediately above. FIG. 10A shows an A type case. As an example, his case type has an ink spot I at a leading edge thereof for detection by sensor 406. It is possible, however, to made the B type case have the ink spot I. Furthermore, if the case is being fed to the left, like it is in case packer 10, major side $S_M$ and major flap $F_M$ are leading with minor side $S_N$ and minor flap $F_N$ trailing. On the other hand, as shown in FIG. 10B, a B type case lacks ink spot I. Furthermore, minor side $S_N$ and minor flap $F_N$ are leading with major side $S_M$ and major flap $F_M$ trailing. A and B type cases are made as shown in FIG. 10C. There, an ordinary case having flaps at both its ends is slit (cut) down its axis. This results in two cases having mirror images of one another and flaps at only one of their ends. However, when the lower case is flipped so that it can be fed with its flaps upward, it will be inverted with respect to the upper case. The case blank manufacturer then prints the requisite indicia on the selected type of case. Note that while A and B type cases have been discussed in the context of cases having flaps at only one end, even cases having flaps at both their ends come in A or B types and the invention is not limited to cases having flaps at only one end.

Figure 8A:
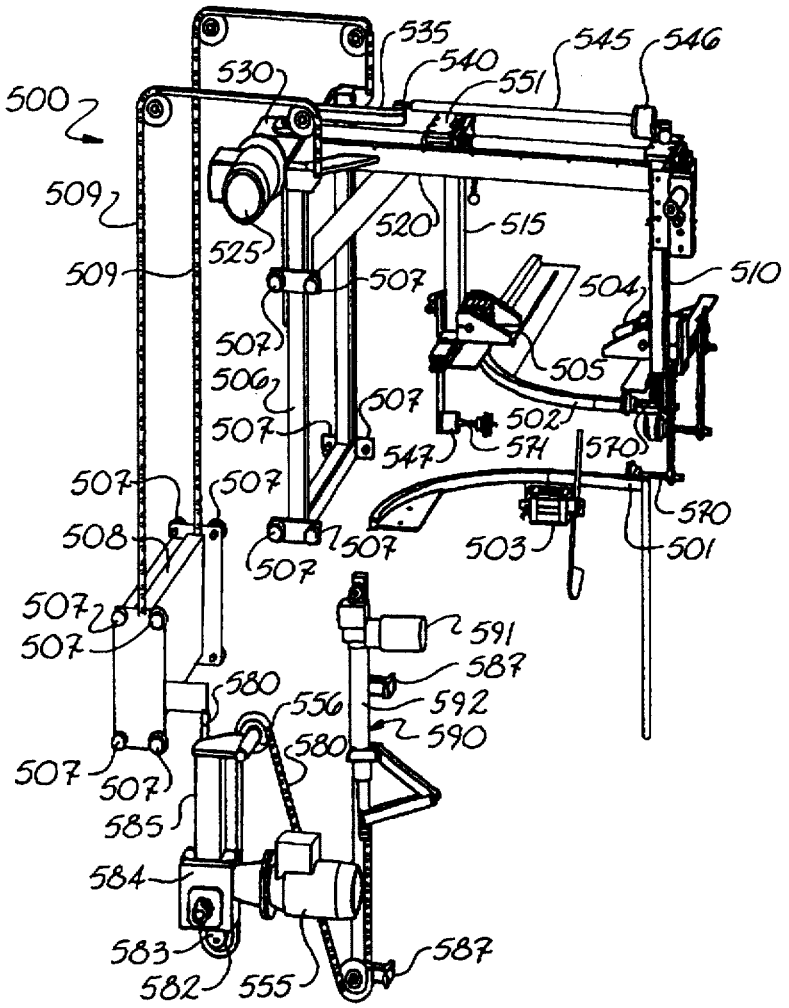
FIGS. 8A–C are assembly views of a case unfolder and erector according to the invention.
Figure 8B:
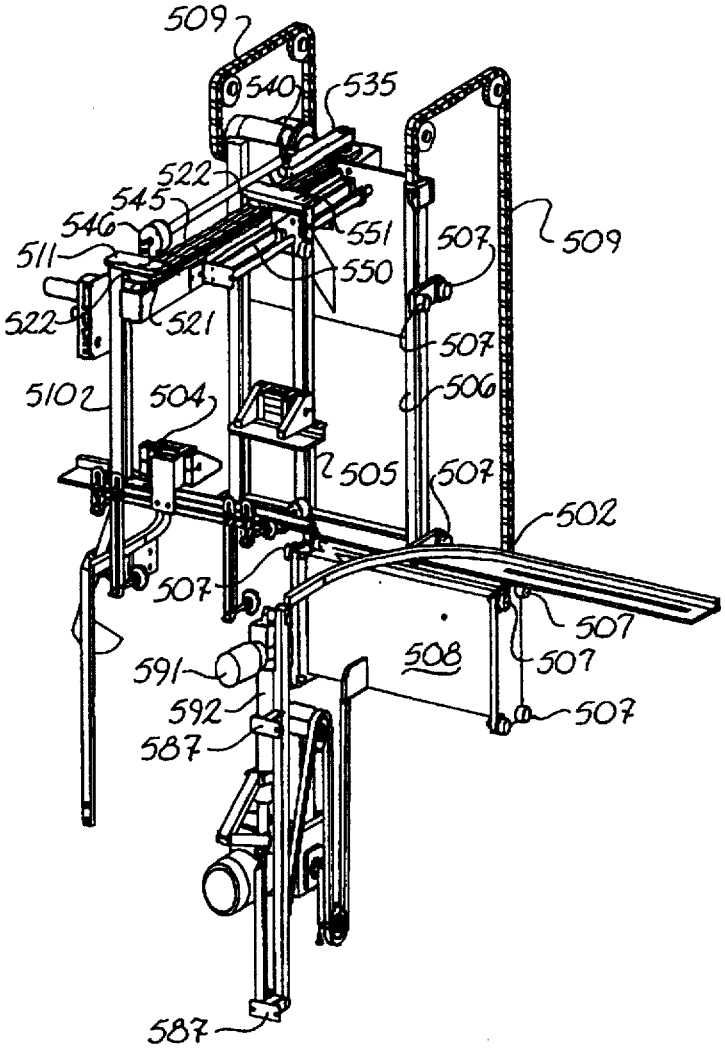
Figure 8C:
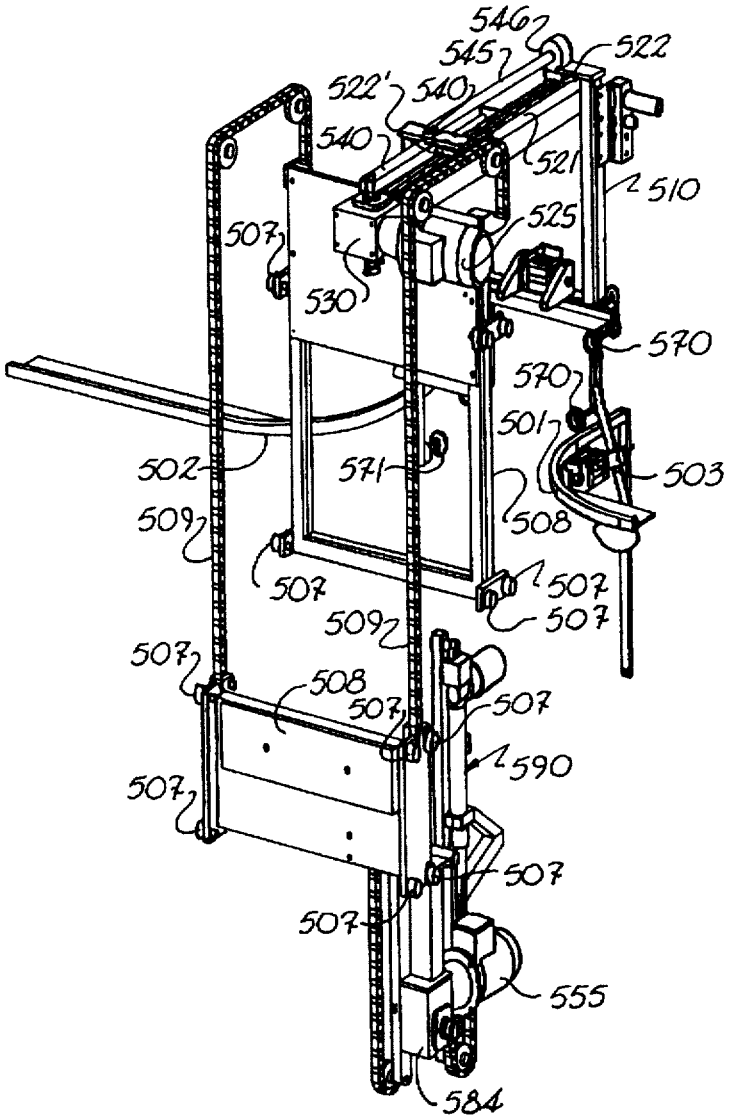

As A type cases are opened to the right while B type case are opened to the left, to open both types of cases, case packer 10 is provided with a case opening and erecting mechanism that can open both types of cases. Case packer 10 does not need any modification when switching from A to B-type cases and can actually work with a mixture of both types of cases placed in case magazine 200. This is unheard of with respect to the prior art where major machine modifications and/or case sorting are required. The unfolding and erecting mechanism 500 shown in FIGS. 8A–C will be referred to as "case erector 500" for simplicity. Case erector 500 is of the type that brings the unfolded and erected case down over the articles to be cased, which are kept stationary. The stack of articles are not lifted into the case. Furthermore, to date and to our knowledge, no one has made a such a case erector and packer in the situation where the case used has flaps at only one of its ends.

As stated above, case erector 500 has to be able of unfolding cases both to the left and to the right. Accordingly, case erector 500 is provided with left and right stationary plows 501, 502 (left and right as viewed by standing in front of and looking straight at case packer 10). Case blank shuttle assembly 400 is designed such that if a B type case is detected by sensors 405, 406 as fed to erector 500, the B type case is fed an additional amount into case erector 500 equal to the length of minor side $S_N$. This additional movement is detected by the encoder (not shown) and places minor side $S_N$ in a position where it can come into contact with left plow 401 and front major side $S_M$ is centered in front of and can come into contact with the front grippers of case erector 500. If an A type case is feed to erector 500, it is stopped as soon as it enters case erector 500 and is not further fed. This places minor side $S_N$ in a position where it can come into contact with right plow 502 and front major side $S_M$ is centered in front of and can come into contact with the front grippers of case erector 500. Thus, either type of case can be unfolded using the same case erector 500.

When unfolding the case, the front and rear major sides are pulled away from each other. Thus, front and rear gripper members 570, 571 are provided. Front grippers 570 grip, pull, and adhere to front major sides $S_M$ such that front major side $S_M$ can be pulled outward to a point where the case will be entirely unfolded. Rear gripper 571 does not move as far out as front grippers 570 and is used to grip the rear major side of the case to keep the case in proper alignment as it is plowed open and lowered. Grippers 570, 571 are vacuum grippers.

Front grippers 570 move back-and-forth along top frame 520. Front frame 510, adjustably supporting front grippers 570, is mounted for slidable movement with respect to top frame 520 by use of, for example, a linear slide 521 in top frame 520 and a sliding block 522 in carriage 511 of front frame 510. To slide front frame 510 and its associated grippers 570, front frame 510 is connected to motor 525 through transmission 530 and a pin and linkage arrangement 535, 540, 545. Finally, cylinder 546 is used to provide slightly more displacement to front frame 510. This is needed so that grippers 570 are moved far enough away from the front of the erected case to prevent them from rubbing against the front of the erected case.

Rear gripper 571 is moved back-and-forth along top frame 520. Intermediate frame 515, supporting rear gripper 571, is mounted for slidable movement with respect to top frame 520 by the use of linear slide 521 in top frame 520 and sliding block 522' in carriage 551 of intermediate frame 515. To slide intermediate frame 515 and its associated gripper 571, carriage 551 is attached to expansible cylinder 550. Thus, as cylinder 550 expands and contracts, carriage 551, intermediate frame 515, and rear gripper 571 move backwards or forwards dependent upon the direction of motion of cylinder 550. Finally, cylinder 547 is used to provide slightly more displacement to rear gripper 571. This is needed so that grippers 571 is moved far enough away from the rear of the erected case to prevent it from rubbing against the rear of the erected case.

To move the various frames of case erector 500 up and down, an elevator-type drive is provided. Rear frame 506, fixed to top frame 520, rolls along structural members of case packer 10 using rollers 507 (FIG. 1). Rear frame 506 is connected to counterweight 508 by chains 509 which span various idler sprockets. It is possible to use belts and pulleys instead of chains and sprockets. Counterweight 508 also rolls along structural members of case packer 10 using rollers 507 (FIG. 3). Thus, as the counterweight 508 moves up and down, rear frame 506 moves down and up respectively. For actually moving counterweight 508 up and down, it is connected to motor 555. This connection is made by chain 580 being attached to counterweight 508 at a first end and prepositioning mechanism 590 at its second end. The motion is provided by sprocket 582, supported by arm 583 to transmission 584, which itself is attached to motor 555. Thus, motor 555, through transmission 584, imparts harmonic motion on sprocket 582 which acts on chain 580 and causes counterweight 508 to move up and down. Prepositioning mechanism 590 uses motor 591 to operate a wormgear (not shown) in cylinder 593 and is mounted to structural members of case packer 10 by brackets 587. Prepositioning mechanism 590 assures that cases of different sizes can be opened by erector 500. While this is the preferred overall method by which the grippers of case erector 500 are moved up and down, any method may be used.

Finally, case erector 500 is provided with mechanisms for closing the various flaps of the unfolded and erected case. In particular, erector 500 is provided with left minor flap plow 503, front major flap plow 504, and rear major flap plow 505. These plows are conventional and close their respective flaps after the unfolded case is lowered. For closing the right minor flap, the plows 131 described with reference to transfer assembly 100 are used. Plows 131 close the right minor flap after the unfolded case has been lowered over the group of articles to be cased, as shown in FIGS. 4H–K.

Figure 9A:
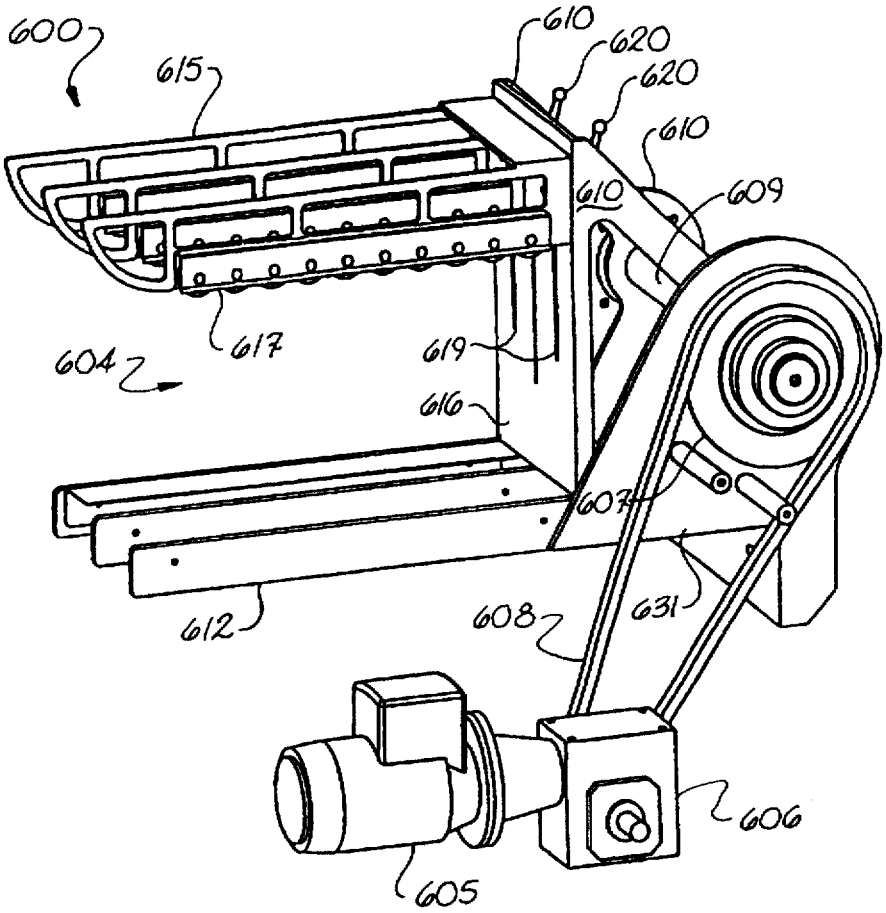
FIGS. 9A and 9B are assembly views of a case invertor for use with the case packer according to the invention.
Figure 9B:
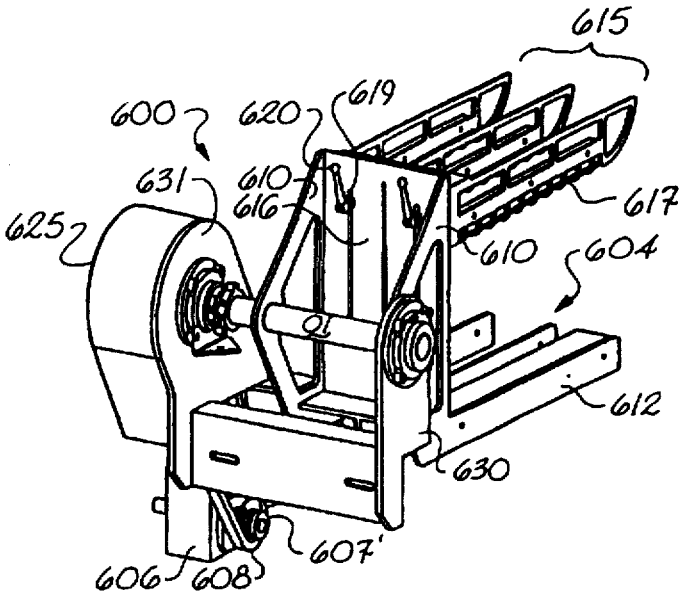

The last major assembly of case packer 10 comprises case invertor 600, which is shown in FIGS. 9A and 9B. Case invertor 600 is required because after the group of articles are cased, the flaps are on top with the open and not flapped side of the case facing down. Any attempt to lift the packed case and place it onto a conveyor for feeding to, for example, a wrapping or closing machine, would result in all the cased articles falling out of the open end. Thus, case invertor 600 is used to either assist the operator in placing the packed case flaps down onto an adjacent conveyor or does that itself.

Case invertor 600 comprises a packed case receiving space 604, defined by upper fork 615, lower fork 612, and rear plate 616, and is U-shaped. Upper fork 615 has rollers 617 that make it easier for the operator to remove a packed case from the inverted case invertor 600. The distance between upper fork 615 and lower fork 612 is adjustable by use of clamps 620 that pass through slots 619 in rear plate 616. Connected to, and preferably integral or unitary with, rear plate 616 are side plates 610. Side plates 610 each have a hole therethrough for shaft 609 to pass through. A not-shown conventional structure assures that shaft 609 and side plates 610 cannot rotate with respect to each other. Thus, as shaft 609 is rotated, side plates 610, and upper and lower forks 615, 612 also rotate. Shaft 609 is rotatably supported at its two ends by fixed side supports 630 and 631.

For rotating shaft 609, a drive mechanism is provided. This mechanism uses a motor 605 connected to transmission 606, which itself is connected to drive sprocket 607'. Idler sprocket 607 is fixedly mounted to the end of shaft 609 closest to motor 605. Chain 608 is wrapped around sprockets 607', 607. Finally, shroud 625 is placed over the drive mechanism to protect the user from injury.

Case invertor 600 operates as follows. After a closed case is pushed into packed case receiving space 604 by forks 130 and plows 131 (FIG. 4K), motor 605 is signalled to turn on. Through the sprockets and chain, shaft 609 rotates about 200°. This results in side plates 610 turning. Because they are attached to rear plate 616, which itself is connected to upper and lower forks 615, 612, the packed case receiving space 604 and the packed case therein also rotates, thereby inverting the packed case and positioning the entrance to packed case receiving space 604 adjacent a delivery conveyor. Due to the fact that case receiving space 604 moved through greater than 180°, it will be facing downward and, therefore, the packed case will automatically slide out of case receiving space 604, taking advantage of rollers 617, and onto the conveyor for delivering downstream for further processing.

Having described the structure associated with all the major components of case packer 10, reference will now be made to its operation.

First, the operator fills case magazine 200 with folded and flattened cases. As case packer 10 can handle both A and B type cases, there is no need for the operator or the case manufacturer to sort the folded and flattened cases into groups of A or B types. The source of articles to be cased, in this invention, a conveyor feeding imbricated and flattened boxes I for containing such items as foodstuffs, is started. This feeds articles I towards transfer assembly 100 of case packer 10.

The operator, as described above with reference to FIGS. 4B–F, will form the group of on edge articles. This is achieved by case packer 10 automatically placing fork 102 in its second position, above slatted table surface 101. Next, the operator lifts the laterally spaced last article of the group, which lifts all the articles since they are imbricated, and holds them on edge and against fork 102. Starting case packer 10 causes case packer 10 to automatically use case blank separator 300 to continuously and at a suitable frequency separate and remove the first case to be separated from magazine 200. This separated and removed case is then fed downstream by case blank shuttle 400 with sensors 406 and 407 determining whether the case is an A or B type case. Upon that determination, the case is fed to the proper position inside case erector 500. Case erector 500 then unfolds and erects the case and positions it above the case packing location.

Upon sensor 23 in back-guide 22 detecting articles, a signal is generated, causing fork 103 to take its second position, above slatted table surface 101. The operator then releases the last article in the group and squares the group with his or her hands along the top and sides. This provides for a completely squared group of articles. After the operator squares the group of on edge articles, he or she presses button 120. In place of this button a suitable time delay may be used. The button or the time delay triggers an automatic mode that causes case transfer assembly 100 to compress the group of articles and simultaneously slide it along slatted table surface 101 until it comes to the case packing location directly under the erected and opened case, where it is stopped. Then, the unfolded case is automatically lowered over the grouped articles with its open and unflapped end leading and its flapped end trailing. The unfolded case is lowered directly over forks 102, 103 which have compressed the group to a size smaller than that of the case. Note that it is possible that in certain situations, such as where the compressed group of articles is close to the size of the case, it may be necessary that forks 102, 103 are lowered slowly by their respective cylinders such that they do not interfere with the lowering case yet do not allow the group of articles to fall apart. After the case is lowered over the articles, the left minor, front major, and rear major, flaps are closed by their respective plows. Then, retracted forks 102, 103 are moved in unison under slatted table surface 101 back to the grouping area, where a new group is made in the same manner as the first group. While this new group is being made, plows 131 are ejected out from under slatted table surface 101 to close the right minor flap. When the new group is completed, it is moved to its position under a newly erected case by forks 102, 103. As fork 130 is rigidly connected to fork 103 by bar 155, simultaneously with the movement of this group, fork 130 and plows 131 of case transfer assembly 100 then push the packed case into packed case receiving space 604 of case invertor 600. The right minor flap plows 131 are moved out of the way of the case by fourth cylinder 134 and then lowered to their first position under slatted table surface 101 and then all the forks of transfer assembly 100 are moved back to a position where another group of on edge articles can be formed. Case invertor 600 then inverts the packed case and the operator pushes it onto the not-shown delivery conveyor. The process is then repeated.

As can be seen from this description of the operation of case packer 10, the device is substantially automated and only requires minimal work on behalf of the operator. Thus, it is a high speed machine as distinguished from the prior art. In particular, all the operator need do is fill case magazine 200, form the groups of on edge articles, completely square the group, and press a few buttons. This makes operation of case packer 10 simple and require minimal side-to-side and repetitive movements on behalf of the operator. Thus, the risk of carpal tunnel syndrome and operator fatigue is reduced.

The above description is given in reference to a case packer having improved features. However, it is understood that many variations are apparent to one of ordinary skill in the art from a reading of the above specification and such variations are within the spirit and scope of the instant invention as defined by the following appended claims.

That which is claimed:

1. A case packing apparatus comprising:

a supply of folded cases;

a separator for separating one case from said source of cases;

a case shuttle for feeding said separated case downstream;

a case unfolding mechanism downstream of said case shuttle and to which said case shuttle feeds said separated case, said case unfolding mechanism for unfolding a case and bringing said unfolded case into proximity of a group of articles to be packed in said case;

a source of incoming imbricated articles;

a transfer assembly for: (a) grouping said imbricated articles and standing them on edge and (b) for transferring said group of articles standing on edge from a first position distant said case unfolding mechanism to a second position under said case unfolding mechanism; and whereby said separated case is unfolded and brought over said group of articles by said case unfolding mechanism, thereby placing and packing said articles in said unfolded case.

2. The apparatus according to claim 1 wherein said imbricated articles are imbricated folded cases.

3. The apparatus according to claim 1 wherein said folded cases have flaps at only one end thereof and said unfolded case is lowered over said group of articles with said flapped end trailing.

4. The apparatus according to claim 3 wherein said case unfolding mechanism further comprises flap closing mechanisms for closing said flaps of said unfolded case after it is lowered over said group of articles.

5. The apparatus according to claim 1 wherein:

said folded cases further comprise a mixed supply of A or B type cases, said A and B type cases being distinguished by whether they open to the left or right, respectively;

said case unfolding mechanism comprises left and right stationary unfolding plows;

a sensing mechanism positioned at an end of said case shuttle and before said unfolding mechanism, said sensing mechanism detecting whether said folded case is an A or B type case, said sensing mechanism sending signals to said case shuttle dependent upon whether said case is detected to be an A or B type case; and whereby: (a) if said sensing mechanism detects said case is an A type case, said sensing mechanism sends said case shuttle a signal that stops said folded case at a first point within said case unfolding mechanism and said case is unfolded using said right plow and (b) if said sensing mechanism detects said case is a B type case, sensing mechanism sends said case shuttle a signal that stops said folded case at a second point within said case unfolding mechanism and downstream of said first position and said case is unfolded using said left plow.

6. The apparatus according to claim 1 wherein said supply of folded cases comprises a case magazine in which said cases are stored on edge and at an angle.

7. The apparatus according to claim 1 wherein said separator comprises pivotable and vertically movable grippers that pivot towards and away from said supply of cases and move vertically with respect to said case blank shuttle, whereby said grippers pivot towards said supply of cases, grip the first case of said supply, lift said gripped case, pivot said gripped case to a position over said case blank shuttle, lower said gripped case into said case blank shuttle, allow said case blank shuttle to feed said case downstream, and then pivot back towards said supply of cases to grip the next case in said supply.

8. The apparatus according to claim 1 wherein said case shuttle comprises a conveyor belt having lugs that push a lower edge of a case resting on said belt.

9. The apparatus according to claim 8 wherein said case shuttle further comprises: front and rear face plates with said lugged conveyor belt therebetween, said front and rear face plates having slots therein for passage of a portion of said separator therethrough as said separator pivots back towards said supply of cases to grip the next case in said supply.

10. The apparatus according to claim 1 wherein said transfer assembly comprises:

a slatted table surface onto which said imbricated articles are fed, said imbricated articles being fed such that an operator can visually discern a predetermined number of imbricated articles;

first and second movable fork mechanisms for supporting said grouped articles therebetween and for moving said grouped articles down said slatted table surface, said first and second fork mechanisms including first and second forks, respectively, having a first position where said forks are below said slatted table surface and a second position where said first and second forks protrude through the slats in said slatted table surface;

sources for generating first and second signals; and whereby upon receipt of said first signal, said first fork moves to said second position whereat said operator grabs and lifts the last of said predetermined number of imbricated articles to place all of said predetermined number of articles on edge and against said first fork, and upon receipt of said second signal, said second fork moves to said second position thereby holding said grasped and lifted articles between said first and second forks allowing said operator to release said last article.

11. The apparatus according to claim 10, wherein the distance between said first and second forks can be varied to allow for the grouping of different predetermined numbers of articles on edge.

12. The apparatus according to claim 10, further comprising a source for generating a third signal causing said first and second fork mechanisms to move said group of articles downstream until they are under said case unfolding mechanism.

13. The apparatus according to claim 11, wherein said third signal also operates a squeezing mechanism for reducing the distance between said first and second forks and therefore squeezing said group of articles.

14. A method of casing articles, comprising the steps of:

providing a source of incoming imbricated articles;

forming said imbricated articles into a group of a predetermined number of articles standing on edge;

providing a source of folded cases;

separating one case from said source of cases;

feeding said separated case downstream;

using a case unfolding and lowering mechanism downstream of where said case is separated to unfold said separated case;

using a transfer assembly to transfer said group of articles standing on edge from a first position distant said case unfolding mechanism to a second position under said unfolding mechanism and said unfolded case; and using said case unfolding and lowering mechanism to lower said unfolded case over said group of articles, thereby placing said articles in said unfolded case.

15. The method according to claim 14 further comprising the step of using sensors to determine whether said separated case is an A or B type case prior to unfolding said case, said A or B type cases being distinguished based upon whether they open to the left or right, respectively, and said unfolding mechanism unfolding said case in one of two different predetermined manners based upon whether said case is an A or B type case.

16. The method according to claim 15, wherein said step of providing a source of folded cases comprises providing a mixture of A and B type folded cases.

17. The method according to claim 14 wherein said step of forming said imbricated articles into a group of a predetermined number of articles and standing said articles on edge comprises:

providing a first stop against which a face of a first of said articles may be placed;

manually lifting the last of a predetermined number of imbricated articles until it is standing on edge, thereby lifting and standing on edge all of said predetermined number of imbricated articles; and providing a second stop adjacent said last of said articles, thereby supporting said predetermined number of articles standing on edge between said first and second stops.

18. The method according to claim 17, further comprising reducing the distance between said first and second stops to compress said predetermined number of articles standing on edge.

19. The method according to claim 17, wherein said step of using a transfer assembly to transfer said group of articles standing on edge to a position under said unfolded case comprises moving said first and second stops with said group of articles therebetween towards said position under said unfolded case.

20. The method according to claim 14 wherein said imbricated articles comprise imbricated folded boxes.

21. The method according to claim 14 wherein said group of articles remain stationary during said step of lowering said unfolded case.

22. The method according to claim 14, wherein said step of forming said group further comprises forming groups of varying numbers of articles.

* * * * *